US007253556B1

(12) United States Patent
Gibboney

(10) Patent No.: US 7,253,556 B1
(45) Date of Patent: Aug. 7, 2007

(54) LIGHT STRING SOCKET WITH MECHANICAL SHUNT

(75) Inventor: James W. Gibboney, Conyers, GA (US)

(73) Assignee: Tech Patent Licensing, LLC, St. Augustine, FL (US)

( * ) Notice: Subject to any disclaimer, the term of this patent is extended or adjusted under 35 U.S.C. 154(b) by 0 days.

(21) Appl. No.: 11/687,024

(22) Filed: Mar. 16, 2007

Related U.S. Application Data

(60) Provisional application No. 60/873,659, filed on Dec. 8, 2006.

(51) Int. Cl.
*H01J 5/50* (2006.01)
*H01R 33/06* (2006.01)
*F21V 21/00* (2006.01)

(52) U.S. Cl. ..... 313/318.01; 313/318.02; 313/318.03; 313/318.05; 362/226; 362/249; 362/653; 362/654; 439/611; 439/619; 439/699.2

(58) Field of Classification Search ..... None
See application file for complete search history.

(56) References Cited

U.S. PATENT DOCUMENTS

| | | | |
|---|---|---|---|
| 1,314,008 | A | 8/1919 | McWilliams |
| 1,536,332 | A | 5/1925 | Dam |
| 2,050,364 | A | 8/1936 | Morton |
| 2,484,596 | A | 10/1949 | Waltz |
| 2,984,813 | A | 5/1961 | Bossi |
| 3,286,088 | A | 11/1966 | Ahroni |
| 3,522,579 | A | 8/1970 | Matsuya |
| 3,783,437 | A | 1/1974 | Graff et al. |
| 4,340,841 | A | 7/1982 | Schupp |
| 4,808,885 | A | 2/1989 | Bauch et al. |
| 4,870,547 | A | 9/1989 | Crucefix |
| 5,139,343 | A | 8/1992 | Lin |
| 5,281,158 | A | 1/1994 | Lin |
| 5,453,664 | A | 9/1995 | Harris |
| 5,791,940 | A | 8/1998 | Chen et al. |
| 5,829,865 | A | 11/1998 | Ahroni |
| 5,852,348 | A | 12/1998 | Lin |
| 6,053,774 | A | 4/2000 | Lin |
| 6,113,430 | A | 9/2000 | Wu |
| 6,257,740 | B1 | 7/2001 | Gibboney, Jr. |
| 6,283,797 | B1 | 9/2001 | Wu |
| 6,347,965 | B1 | 2/2002 | Pan |
| 6,361,368 | B1 | 3/2002 | Tseng |
| 6,533,437 | B1 | 3/2003 | Ahroni |

(Continued)

*Primary Examiner*—Sikha Roy
(74) *Attorney, Agent, or Firm*—Michael A. Mann; Nexsen Pruet Adams Kleemeier, LLC

(57) ABSTRACT

A lamp for a light string has a mechanical shunt to allow current to pass to the next light in the event of a missing bulb. A resilient shunt is held in a generally lateral orientation by a shunt holder within the socket. When the hollow base with its bottom opening is inserted into the socket, the walls of the base cam the ends of the shunt away from the electrical contacts on the walls of the socket. Likewise, when the base is removed, the resilient lateral ends of the shunt return to engage the electrical contacts. The timing of the contact by the shunt with the electrical contacts avoids arcing. Additionally, slits formed in the wall of the base allows the Dumet wires to exit the sides of the base in the correct location for engaging the electrical contacts, thus reducing the instances of misaligned Dumet wires.

9 Claims, 3 Drawing Sheets

U.S. PATENT DOCUMENTS

| | | | |
|---|---|---|---|
| 6,595,657 | B1 | 7/2003 | Shieh |
| 6,609,814 | B2 | 8/2003 | Ahroni |
| 6,805,463 | B2 | 10/2004 | Shieh |
| 6,929,383 | B1 | 8/2005 | Janning |
| 2002/0118540 | A1 | 8/2002 | Ingrassia |
| 2003/0142494 | A1 | 7/2003 | Ahroni |
| 2003/0198048 | A1 | 10/2003 | Frederick |
| 2003/0218412 | A1 | 11/2003 | Shieh |
| 2004/0105270 | A1 | 6/2004 | Shieh |
| 2005/0122723 | A1 | 6/2005 | Frederick |
| 2006/0274556 | A1 | 12/2006 | Massabki et al. |

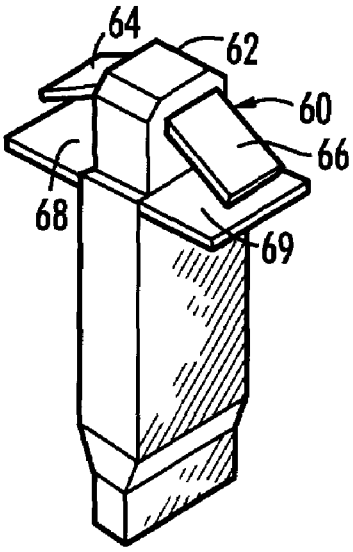
FIG.3
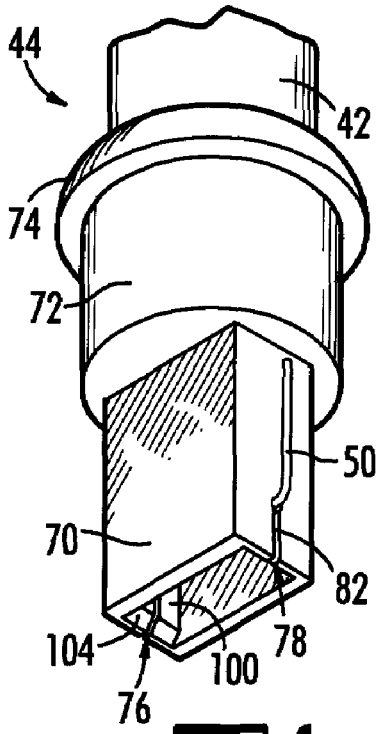
FIG.4
FIG.5
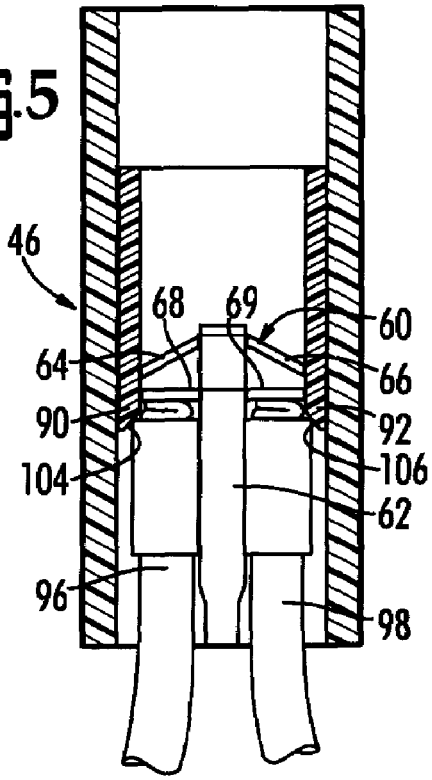

LIGHT STRING SOCKET WITH MECHANICAL SHUNT

CROSS REFERENCE TO RELATED PATENTS

The priority benefit of U.S. provisional patent application Ser. No. 60/873,659, filed Dec. 8, 2006, is claimed

BACKGROUND OF THE INVENTION

The present invention relates to shunts for lamps, particularly lamps arranged in an electrical series with other lamps to prevent all the lamps in the series from losing power when one lamp is removed from its socket.

Lamps such as those in decorative light strings are often arranged electrically in series. When thus arranged, the removal of one lamp will cause an open circuit and the entire series will lose electric power. In a set of Christmas lights on a Christmas tree, for example, it is a tedious task to find which socket is missing its bulb. Unless the empty socket is spotted by luck, one must begin at one end of the string and look at each socket in turn until all of the empty sockets are found.

There have been many attempts to produce shunts to keep power flowing to subsequent lamps in the light series when a lamp in the series burns out or is removed. Most of these involve a shunt wire, often with an oxide coating, or a solid state device, placed either in the lamp globe or in the socket such as a set of diodes that pass current to the next light when the filament burns out. Another approach involves use of a mechanical shunt in the socket to address the particular problem of loose or missing lamps. An example of such a shunt is found in U.S. Pat. No. 6,257,740, which is incorporated herein in its entirety by reference, and is issued to the present inventor and is commonly owned.

The device described in the '740 patent shows a pair of conductive spring terminals that are forced apart when the lamp and its base are inserted into the socket and spring together when the lamp and lamp base are withdrawn. This device works well but nonetheless there remains a need for other ways of shunting the current in a series light string.

SUMMARY OF THE INVENTION

According to its major aspects and briefly recited, the present invention is a lamp having a mechanical shunt, which lamp is useful in strings of lights where the lights are arranged in an electrical series. The present lamp includes a transparent globe with a filament and two external Dumet wires, a base to which the globe is attached and through which the Dumet wires extend, a socket for receiving the base, two conductive electrical contacts inside the socket, parallel to its long dimension, and attached to the interior of the socket wall, a conductive shunt and a shunt holder. The shunt holder is carried by the socket along with the shunt and holds the shunt in a nearly horizontal orientation except for its lateral edges. The edges of the shunt extend to opposing sides of the shunt holder and depend at a small angle in order to engage the electrical terminals on the socket wall. In addition, the shunt holder has non-conductive bar extensions extending laterally below the shunt to facilitate insertion of the shunt holder into the socket and to further isolate the shunt electrically when the lamp base is inserted into the socket.

The base of the present lamp is hollow with an opening in the bottom so that, when the base is lowered into the socket, it receives the shunt holder within its hollow interior through the opening and is thus between the holder and the socket. As the lamp base is lowered over the shunt holder, it cams the shunt's resilient lateral edges down and away from the electrical terminals thus breaking electrical contact. Conversely, when the lamp base is lifted clear of the socket, the resilient lateral edges of the shunt spring back into engagement with the electrical terminals to allow the electrical current to pass from one electrical contact to the other.

An important feature of the present invention is the resilient lateral edges of the shunt holder that can be cammed away from the electrical contacts of the socket by insertion of the base into the socket.

Another important feature of the present invention is the slightly longer base with a vertical slit formed in each side from the bottom edge of the base upward and dimensioned to receive the Dumet wires that extend from the globe down through the upper part of the base. These wires are pulled upward through the slits and are bent outward and upward through the slits on each side. The slits help to hold and center the Dumet wires so that they make good contact with the electrical terminals when the globe and its base are seated in the socket. Moreover, the dimensions of the lamp base are such that the Dumet wires remain in contact with the electrical terminals as the lamp and lamp base are removed so that there is no electrical arcing when the shunt finally engages the terminals. Avoiding arcing prevents pitting of the contact surfaces from excessive heat. The insertion of the lamp base also avoids arcing by allowing the Dumet wires to make contact with the terminals before the shunt breaks contact.

Another feature of the present invention is the use of a conductive shunt with a simple shape and holder. The present shape is simpler to manufacture than other shunts.

Still another feature of the present invention is that it allows a larger shunt, which in turn allows greater electrical current to be passed by the shunt without appreciable increase in temperature.

Yet another feature of the present invention is the plastic lamp base extension that fits snuggly (a "gas fit") against the contact surface of the shunt lateral ends and which thereby helps to keep them free of corrosion from exposure to the atmosphere. In addition, when the lamp base is removed and inserted, it rubs these shunt contact surfaces, keeping them free of dirt, grease and corrosion. Finally, the plastic lamp base isolates the shunt ends from other metals, which helps to avoid Galvanic corrosion.

Any yet another important feature of the present invention is the bar extensions. These non-conductive extensions enable a user to insert the shunt holder into the socket and provide electrical isolation of the shunt from the electrical contacts and the wiring connected to them when the lamp base is inserted into the socket.

These and other features and their advantages will be apparent to those skilled in the art of lamp design from a careful reading of the Detailed Description of Preferred Embodiments accompanied by the following drawings.

BRIEF DESCRIPTION OF THE SEVERAL VIEWS OF THE DRAWINGS

In the drawings,

FIG. 3 is a perspective view of a shunt and shunt holder, according to a preferred embodiment of the present invention;

FIG. 4 is a perspective view from a low angle of a lamp base showing one of two Dumet wires in its slit, according to a preferred embodiment of the present invention;

FIG. 5 is a cross sectional view of a shunt, shunt holder in a socket, according to a preferred embodiment of the present invention;

DETAILED DESCRIPTION OF THE INVENTION

Figure 1:
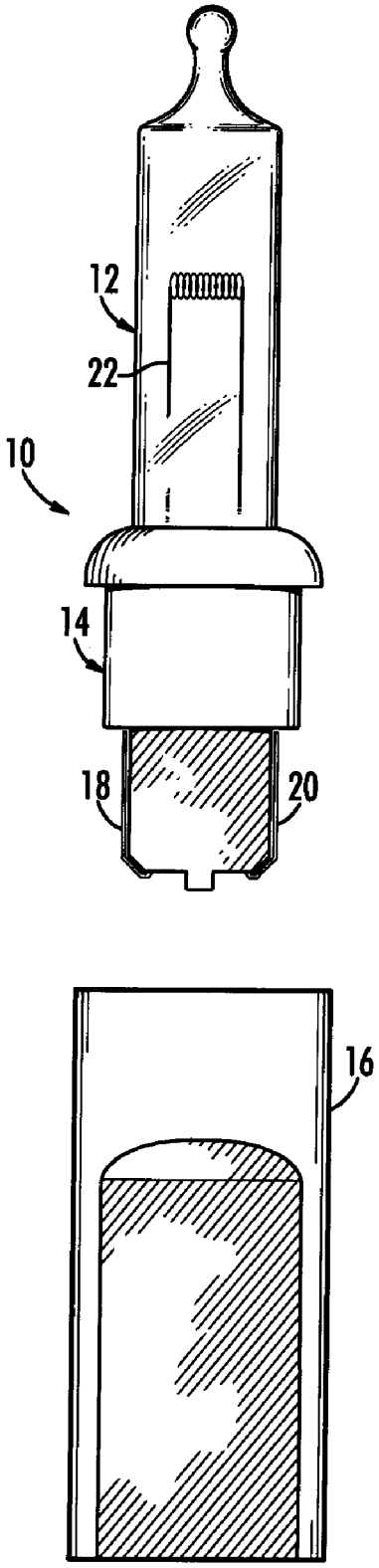
FIG. 1 PRIOR ART
FIG. 1 is a side view of a prior art lamp with the globe and base removed from the socket.

FIG. 1 illustrates a prior art lamp, generally indicated by reference number 10, as viewed from the side, and with a globe 12 in its base 14 removed from its socket 16. Dumet wires 18, 20, extend from the bottom of base 14 and are bent laterally and upwardly along the sides of base 14. Dumet wires 18, 20, pass through base 14 into globe 12 and are in electrical connection with a filament 22 in globe 12 to form an electrical circuit when a voltage is applied across Dumet wires 18, 20.

Figure 2:
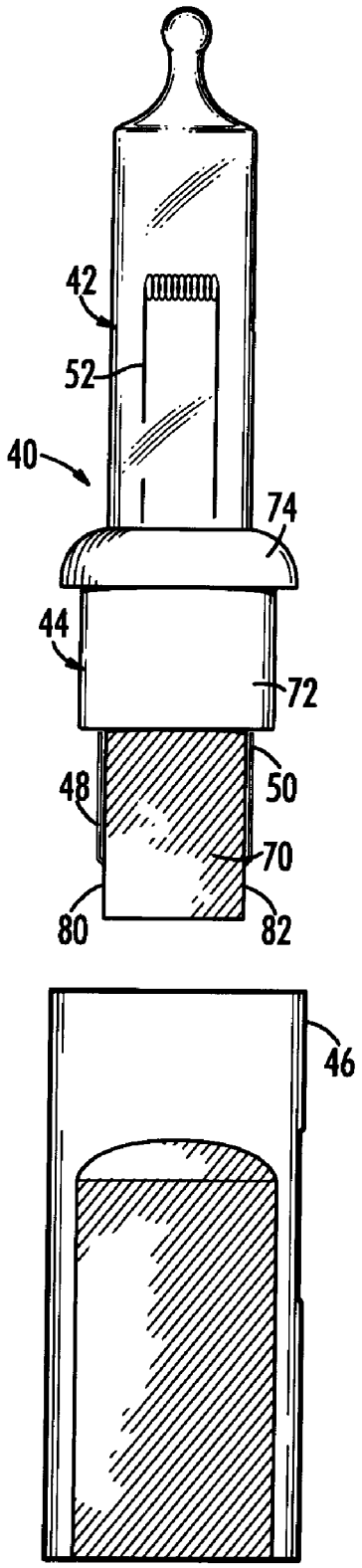
FIG. 2 is a side view of the present lamp with the globe and base removed from the socket, according to a preferred embodiment of the present invention.

FIG. 2 allows comparison of the present inventive lamp 40 to lamp 10 of prior art FIG. 1. Lamp 40 also has a globe 42, a base 44, and a socket 46. Dumet wires 48, 50, exit base 44 from the side rather than the bottom and extend upwardly from the exit point along the sides of base 42. Dumet wires 48, 50 pass through base 44 into globe 42 and are in electrical connection with filament 52 in order to form a circuit when Dumet wires 48, 50 are connected to a source of electricity. It will be appreciated from a side-by-side comparison of lamp 10 and lamp 40 that globes 12, 42 are the same and sockets 16, 46 are the same. Base 44, however, is slightly longer than base 14. Furthermore, it will be also be evident that Dumet wires 48, 50, exit base 44 from the side in contract to Dumet wires 18, 20, which exit base 14 from the bottom.

FIG. 3 is a detailed perspective view of a shunt 60 and shunt holder 62, according to a preferred embodiment of the present invention. Shunt 60 is a single rectangular strip of conductive material, preferably a resilient conductive material such as a metal or metal alloy, and most preferably copper. Shunt 60 has two opposing lateral ends 64, 66, that extend from opposing sides of shunt holder 62 and are bent slightly downward from a horizontal, cantilevered orientation, as illustrated. Finally, shunt holder 62 has bar extensions 68, 69, extending laterally from the main body of shunt holder 62 below shunt 60 by a sufficient distance so as not to interfere with shunt 60.

FIG. 4 illustrates base 44, and part of globe 42, from a lower perspective view. Base 44 has a hollow, rectangular lower portion 70, a cylindrical upper portion 72 and a circular flange 74 on top. Two slits 76, 78 are formed in lower portion 70, on opposing sides 80, 82, and dimensioned for Dumet wires (one, 50, visible in FIG. 4; both wires, 48, 50, visible in FIG. 2). Slits 76, 78, extend from the bottom edge of lower portion 70, upwardly partway long sides 80, 82.

Slits 76, 78, help to position Dumet wires 48, 50 and are therefore an important feature of the present invention. Because of the way prior art lamps are made, in particular without securing Dumet wires 18, 20 in position prior on the sides of base 14 prior to insertion of base 14 into socket 16, Dumet wires 18, 20 often twist or otherwise become misaligned. Indeed, the initial failure rate of lamps approaches 25%. The time required to correct these failures caused by misalignment between the Dumet wires and the electrical terminals attached to the inside wall of the socket, is considerable. Moreover, in addition to the present invention's improvement in positioning Dumet wires 48, 50, the width of the electrical terminals the Dumet wires 48, 50 must engage can be made narrower, thus saving a small amount of metal (usually copper) for each lamp, which, collectively, given the millions of such lamps made each year, is a large savings.

FIG. 5 illustrates a cross sectional side view of socket 46 with shunt 60 and shunt holder 62 inside but base 44 removed, and with electrical terminals 90, 92, attached to the wall 94 of socket 46. Electrical wires 96, 98, are shown in the bottom of socket 46 in contact with electrical terminals 90, 92, respectively. Lateral ends 64, 66, of shunt 60 are in contact with electrical terminals 90, 92, respectively, and thus current passes from wire 96 to electrical contact 90 to lateral edge 64 to lateral edge 66 to electrical contact 92 and finally to wire 98 and on to a next lamp in electrical series that comprises a light string.

When shunt holder 62 is inserted into socket 46, bar extensions 68, 69, facilitate gripping shunt holder 62 and forcing it into position, sometimes against the undercut wires 96, 98 and thereby help to electrically isolate shunt 60 from wires 96, 98, especially in the event of a high voltage spike when arcing might otherwise occur.

Figure 6:
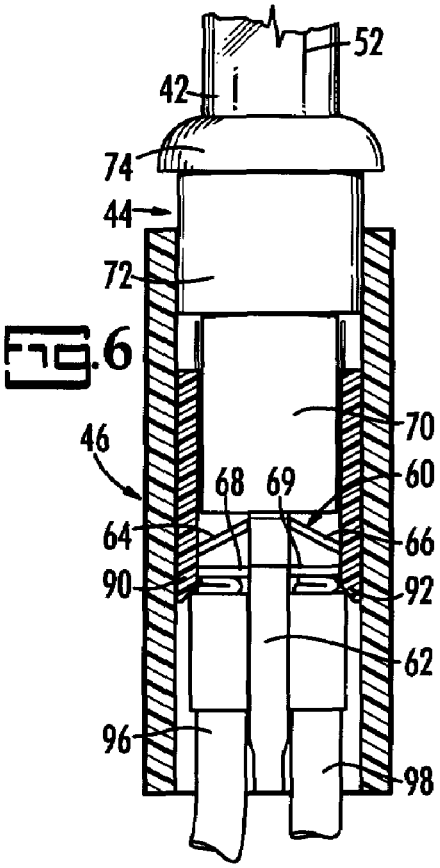
FIG. 6 is the cross sectional view of FIG. 5 with a base partially inserted, according to a preferred embodiment of the present invention.
Figure 7:
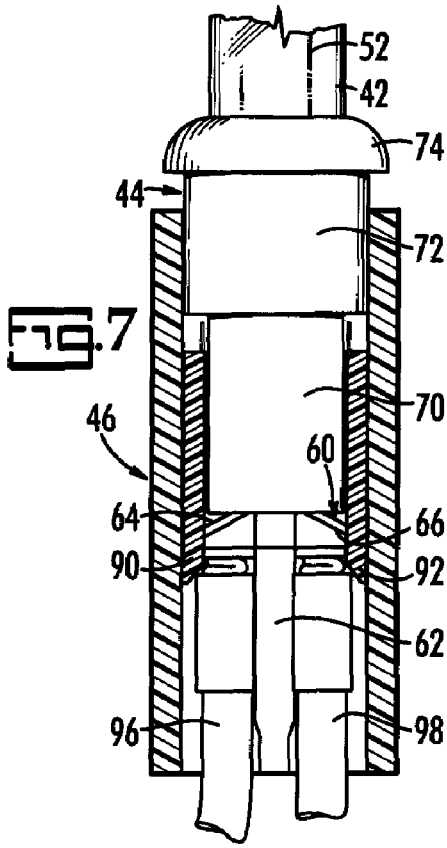
FIG. 7 is the cross sectional view of FIG. 6 with the base almost fully inserted, according to a preferred embodiment of the present invention.
Figure 8:
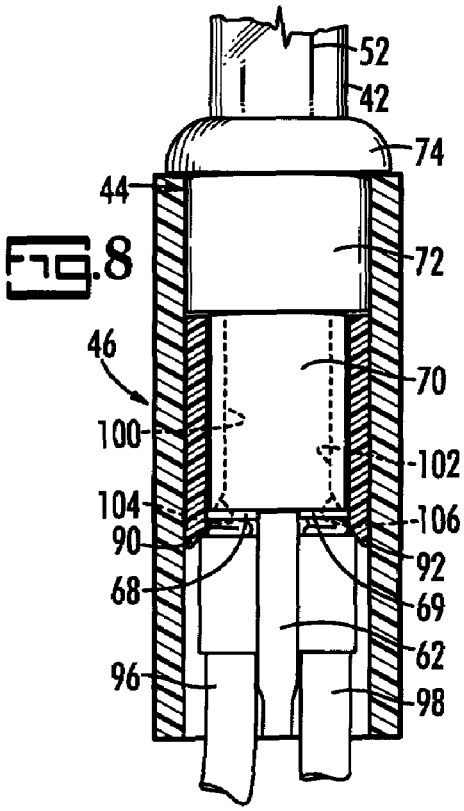
FIG. 8 is the cross sectional view of FIG. 7 with the base fully seated in the socket, according to a preferred embodiment of the present invention.

FIGS. 6, 7 and 8 show the same cross sectional view as seen in FIG. 5 but with base 44 being partially inserted, almost fully inserted and fully inserted, respectively. As base 44 is inserted, lower portion 70 will receive shunt 60 and shunt holder 62, fitting between them and electrical contacts 90, 92 and thereby breaking the circuit through shunt 60 and insulating electrical contacts 90,92, from lateral ends 64, 66, of shunt 60. Lateral ends 64, 66, are cammed downward by the inside walls 100, 102 (see FIG. 4 and FIG. 8) of lower portion 70 of base 44. Note that the bottom edges of walls 100, 102, are beveled at 104, 106, to facilitate the camming of edges 64, 66. When base 44 is lifted, lateral ends 64, 66, resiliently return to position engaging electrical terminals 90, 92. A comparison of FIGS. 7 and 8 will show that base 44 must be fully inserted to break the electrical circuit completed by shunt 60, at which point lateral ends 64, 66, are cammed clear of their contact with electrical terminals 90 and 92 and, meanwhile, Dumet wires 48, 50, have come into contact with electrical terminals 90, 92, respectively, and pass the electrical current to filament 52 in globe 42. This sequence is important for avoiding electrical arcing.

Shunt 60 can be larger than prior art coated filament shunts, for example, and, if so, will allow greater electrical current, well in excess of 9 amps for example, to be passed without undue heating of shunt 60.

The present lamp design prevents arcing and corrosion in the lamp socket by the timing of the breaking and making of contacts with shunt 60. Dumet wires 48, 50, do not break contact with the electrical terminals 90, 92, until lateral ends 64, 66, of shunt 60 come into contact with electrical terminals 90, 92, to avoid arcing. The movement of the lamp base 44 and its "gas-tight" fit, not only rubs dirt, dust, grease and corrosion, if any, off lateral ends 64, 66, but electrically isolates them and electrical terminals 90, 92, so that no Galvanic corrosion takes place and access to air and its moisture are restricted. A "gas-tight" fit substantially limits the free flow of gas between surfaces at atmospheric pressure; a gas-tight fit is a snug fit along all points of contact.

In use the present lamp 40 as part of a light string is easy to troubleshoot. If a lamp falls out, the string will continue to be lighted because the empty socket will pass the current. If the whole string is out, each bulb can be removed, one at a time, to see which bulb, when removed, re-lights the string. When a bulb is found that, when removed from its socket, causes the string to re-light, the removed bulb is the defective one because the removal will allow the shunt to pass current and it is the defective bulb's presence that prevents the current from being passed. There is no need to stick a screw driver, for example, in the socket to pass current, as in prior art light string trouble shooting. Furthermore, when a bulb is removed, the electrical potential in the socket is near zero rather than 120 volts and three amps as in prior art, un-shunted lamp sockets, so the present socket is much safer.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A lamp for use with a light string, said lamp comprising:

a globe;

a base attached to said globe;

a filament inside said globe;

first and second Dumet wires running from outside said base to said filament inside said globe;

a shunt;

a shunt holder adapted to hold said shunt, a socket carrying said shunt holder and dimensioned to receive said base; and a first and an opposing second electrical contact carried within said socket, said first and said second electrical contacts being in electrical connection with said first and second Dumet wires, when said base is in said socket, so that an electrical circuit is formed from said first electrical contact to said first Dumet wire to said filament to said second Dumet wire to said second electrical contact, and wherein when said base is removed from said socket and electricity is supplied to said first electrical contact, said shunt conducts said electricity from said first electrical contact to said second electrical contact, and wherein said base has a bottom and is hollow and has an opening at said bottom and is dimensioned to receive said shunt and said shunt holder within said hollow base when said base is inserted into said socket, said base thereby being between said shunt and said first and second electrical contacts.

2. The lamp as recited in claim 1, wherein said base has sides and said Dumet wires exit said base from holes in the sides of said base rather than from said bottom of said base to engage said electrical contacts.

3. The lamp as recited in claim 2, wherein said base has a bottom edge defining said opening, and said base further comprises two slits formed in said sides of said base from said bottom edge for placing said Dumet wires to exit said sides in position to engage said first and second electrical contacts when said base is inserted in said socket.

4. The lamp as recited in claim 1, wherein said shunt has first and second side edges cantilevered from said shunt holder.

5. The lamp as recited in claim 4, wherein when said base is inserted into said socket, said base cams said side edges away from said first and second electrical contacts.

6. The lamp as recited in claim 5, wherein said base and said shunt holder are dimensioned so that, just before said base cams said side edges away from said first and second electrical contacts, said Dumet wires engage said first and second electrical contacts so that arcing is avoided.

7. The lamp as recited in claim 5, wherein said base and said shunt holder are dimensioned so that, when said base is removed from said socket, said first and said second side edges engage said first and second electrical contacts before said first and second Dumet wires disengage said first and second electrical contacts so that arcing is avoided.

8. The lamp as recited in claim 1, wherein said shunt holder fits "gas tight" within said hollow base.

9. The lamp as recited in claim 1, wherein said shunt holder has non-conductive bar extensions extending laterally of said shunt holder and positioned below said shunt.

* * * * *